United States Patent [19]

Schips

[11] Patent Number: 4,841,889

[45] Date of Patent: Jun. 27, 1989

[54] METHOD AND APPARATUS FOR MAKING CONTOUR SEAMS

[75] Inventor: Helmut Schips, St. Gallen, Switzerland

[73] Assignee: Schips AG Nahautomation, Tuebach, Switzerland

[21] Appl. No.: 14,448

[22] Filed: Feb. 13, 1987

[30] Foreign Application Priority Data

Feb. 17, 1986 [CH] Switzerland ..... 619/86

[51] Int. Cl.[4] ..... D05B 1/00

[52] U.S. Cl. ..... 112/262.3; 112/121.12; 112/306

[58] Field of Search ..... 112/262.3, 262.1, 121.12, 112/309, 2, 102, 103, 306, 121.11, 308, 153

[56] References Cited

U.S. PATENT DOCUMENTS 3,742,879 7/1973 Schaefer, Jr. et al. ..... 112/121.12
4,050,393 9/1977 Welcher et al. ..... 112/121.12
4,117,790 10/1978 Hasegawa et al. ..... 112/309
4,498,404 2/1985 Sadeh ..... 112/121.12
4,681,048 7/1987 Willenbacher ..... 112/262.3

*Primary Examiner*—Peter Nerbun
*Attorney, Agent, or Firm*—Burns, Doane, Swecker & Mathis

[57] ABSTRACT

The method of making contour seams on material to be sewn starts from a sewing position in which the material to be sewn has been clamped in spread manner, before the sewing operation, by means of three gripping points provided along a contour line. The contour line is defined by the pattern of the cut and superimposed fabric edges of pieces of material to be sewn together. The gripping point closest to the sewing-machine is stationary, and the two other gripping points are each supported so as to be movable in a polar coordinate system. Initiation of the sewing operation is effected each time with simultaneous release of the material to be sewn in the stationary gripping point, and in at least part of the sewing operation the stitch chain is guided parallel to the contour line in opto-electronic control.

6 Claims, 10 Drawing Sheets

METHOD AND APPARATUS FOR MAKING CONTOUR SEAMS

The present invention relates to a method of making contour seams on material to be sewn, in particular elongate pieces of material to be sewn.

In accordance with the known method the material to be sewn must be moved during the sewing operation by the operator of the sewing-machine with the required care in such a manner that it follows the predetermined contour. This is an exacting activity necessitating considerable expenditure of time and presupposing the existence of operating staff with corresponding qualification.

Due to the fact that time and experienced personnel become increasingly rarer, it is the object of the invention to make available a method permitting the contour sewing to be carried out without manual work, in reliable manner but nevertheless within a useful cycle time.

In accordance with the present invention, this object is met by the method measures according to the characterizing part of patent claim 1.

With the aid of a relatively simple opto-electronic guidance of the stitch chain or sequence which progresses longitudinally ahead of cut fabric or material edges of pieces of material to be sewn together, and which at the time controls the feed of the material to be sewn towards the sewing needle of the sewing-machine by purposefully influencing the motion of at least one gripping point gripped at the fabric edges in an associated polar coordinate system, with the course of the sewing operation starting in particularly expedient manner from a sewing position that is defined exactly by the three-point mounting, the contour sewing process can be performed automatically and rapidly and in conformity with the existing quality standards.

In this respect, the specific contour line determined by the cut of the fabric edges to be sewn together may have the configuration of a curved part with arbitrarily variable curvature.

It is recommendable to provide for mechanical parallel guidance of the stitch chain or sequence in that section of the sewing operation which follows the section with opto-electronical stitch chain guidance and which is to be carried out along a rectilinear contour line.

The opto-electronic stitch chain guidance can be carried out in many cases in such advantageous manner that it influences merely the movement of the middle gripping point on the fabric edges in the polar coordinate systems thereof.

The mechanical stitch chain guidance may expediently be carried out by a linear shift of the gripping point remotest from the sewing-machine after release of the material to be sewn in the middle gripping point which is stationary after having moved through its opto-electronically controlled path of movement, and with the fabric edges moving towards the sewing-machine being guided at the same time at said middle gripping point.

Considerable acceleration of the contour sewing operation is achievable when supplying the material to be sewn to the sewing position in a manner in which it is already held in identical manner at the same three gripping points.

The apparatus for performing the method according to the invention is characterized by the features indicated.

The invention will be elucidated in more detail by way of example on the basis of an embodiment with reference to the accompanying drawings, in which FIG. 1 shows a simplified overall perspective view of an apparatus for performing the method according to the invention together with auxiliary means for supplying the material to be sewn;

Figure 4A:
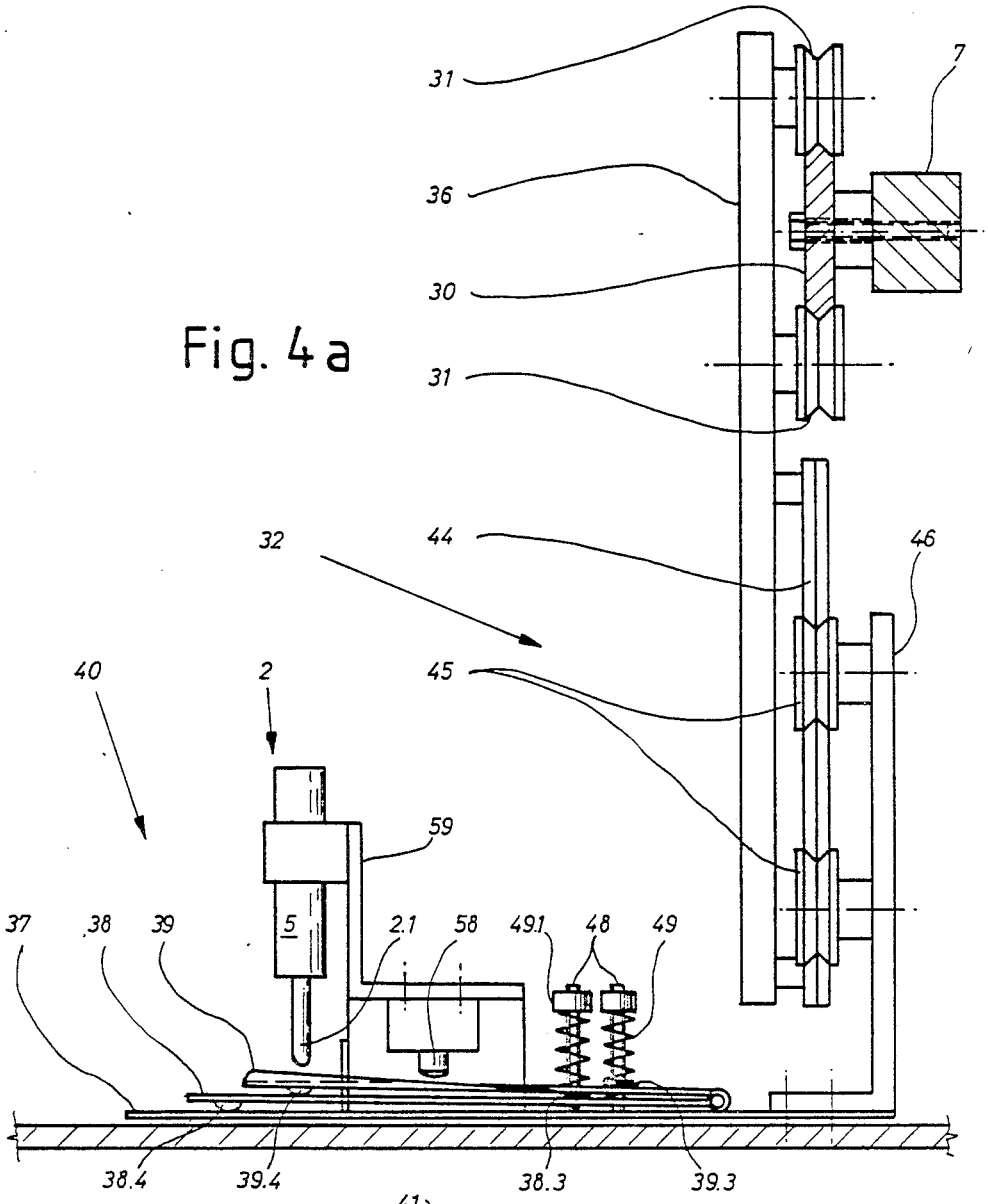
Figure 4B:
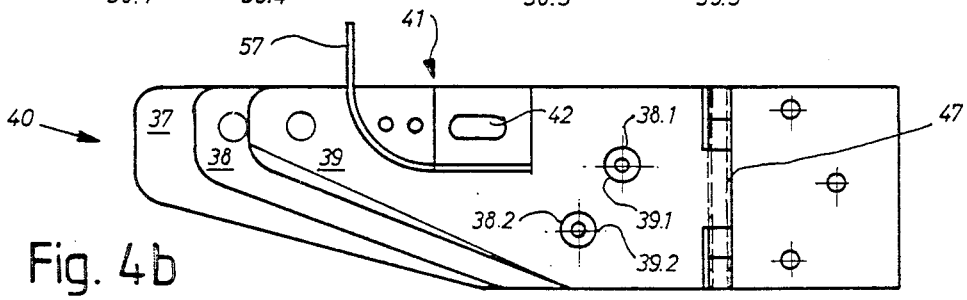

FIG. 4*a* shows a side view of a carriage carrying a gripping means for the material, the movement of said carriage during contour sewing taking place in the form of polar coordinates and being controlled by photocells disposed in front of the sewing needle of the sewing-machine;

FIG. 4*b* shows a plan view of the gripping means according to FIG. 4*a;*

Figure 1:
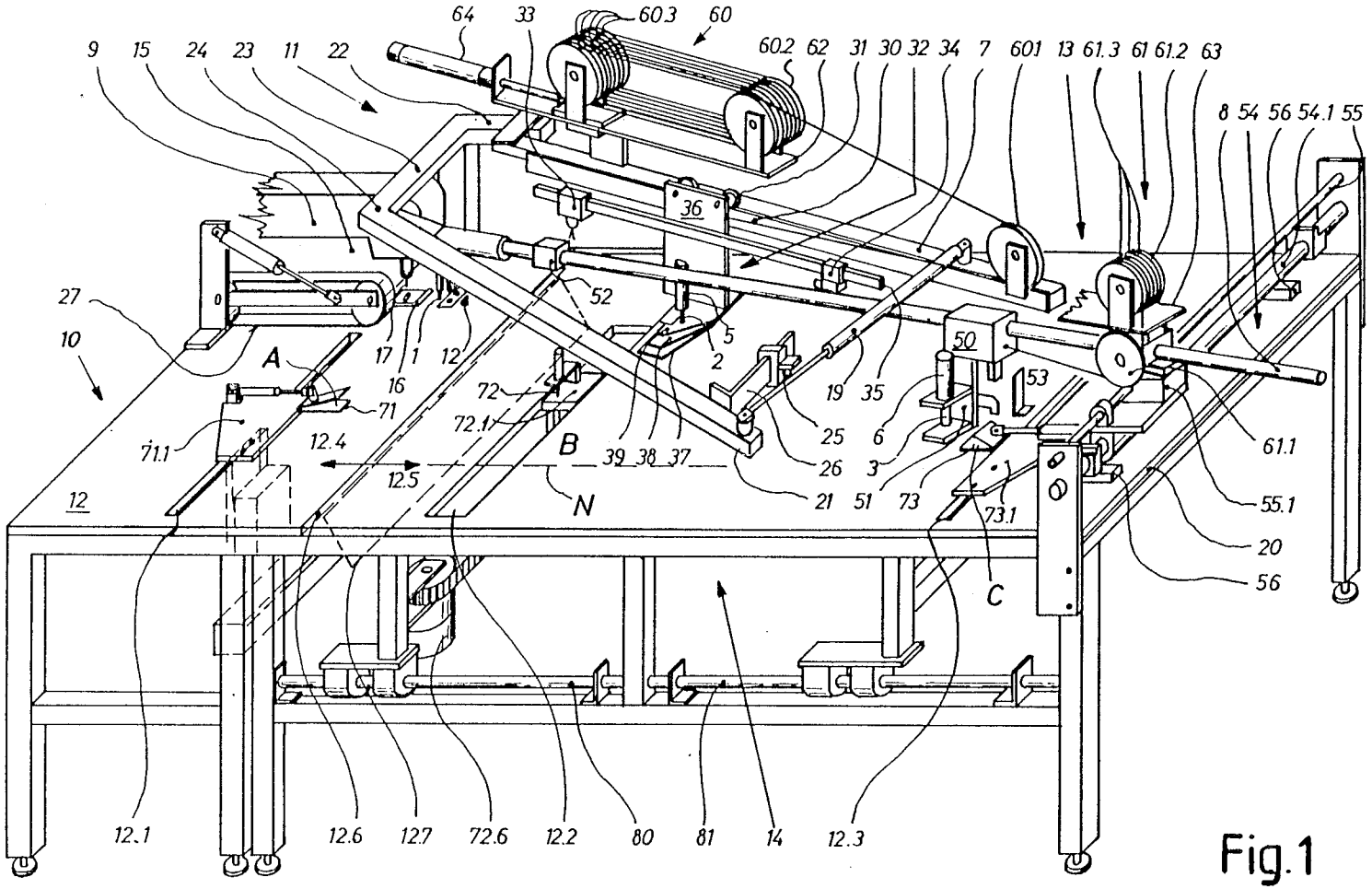
Figures 5A, 5B:
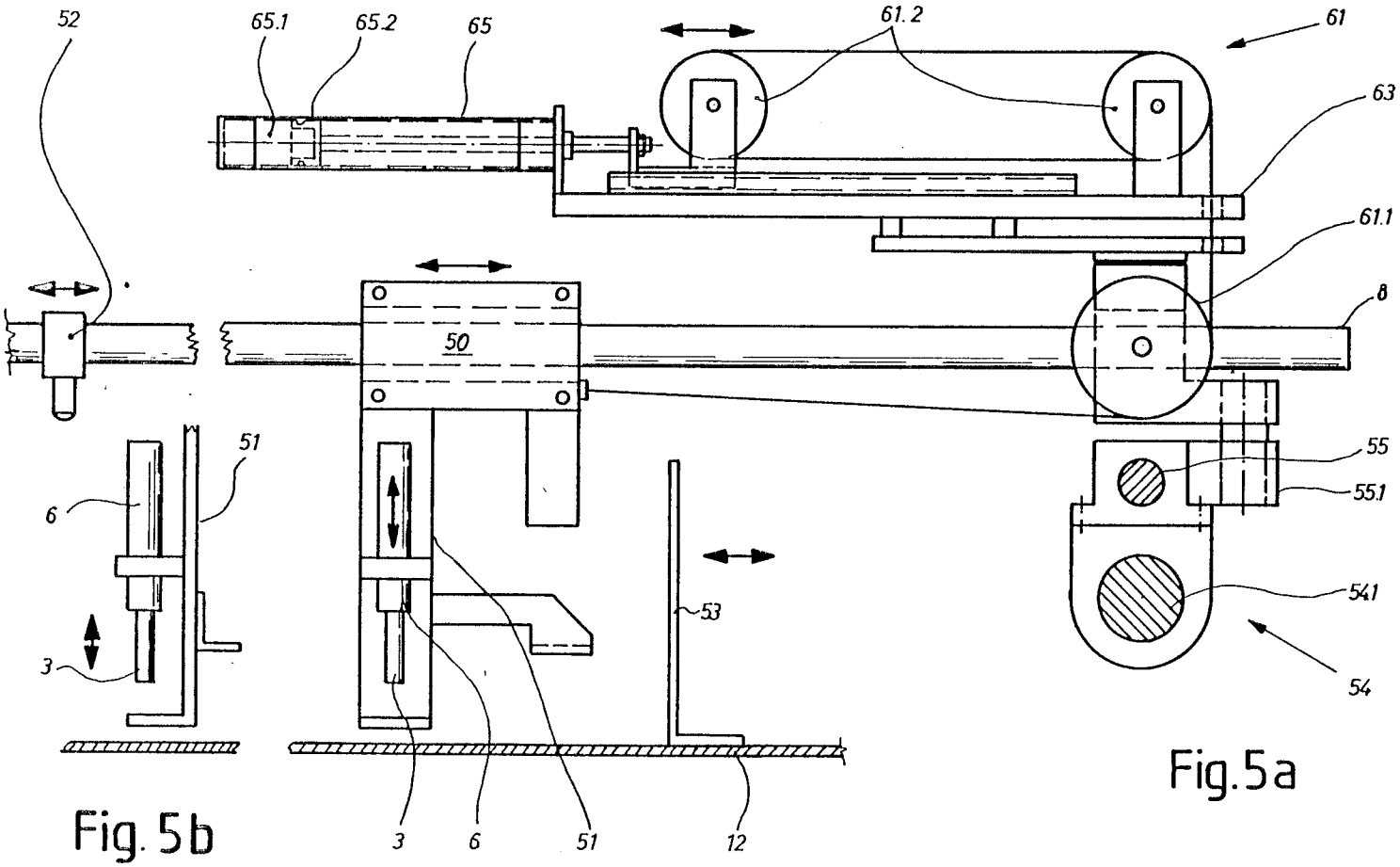

FIG. 5*a* shows parts of the apparatus according to FIG. 1 rendering possible the making of a rectilinear contour seam with mechanical stitch chain guidance subsequent to a curved contour seam made by means of opto-electronic stitch chain guidance;

FIG. 5*b* shows a side view of the mechanically guided gripping means for the material according to FIG. 5*a;*

Figure 6:
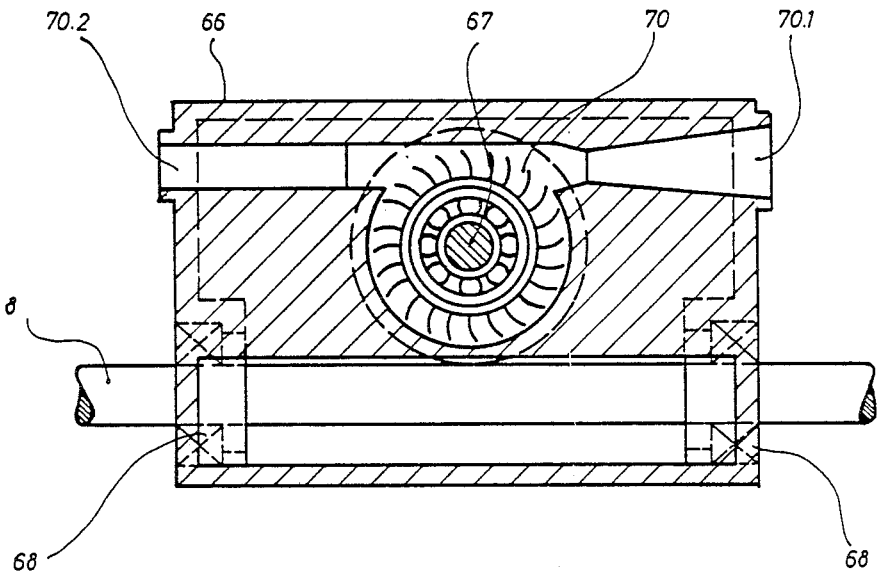
Figure 6:
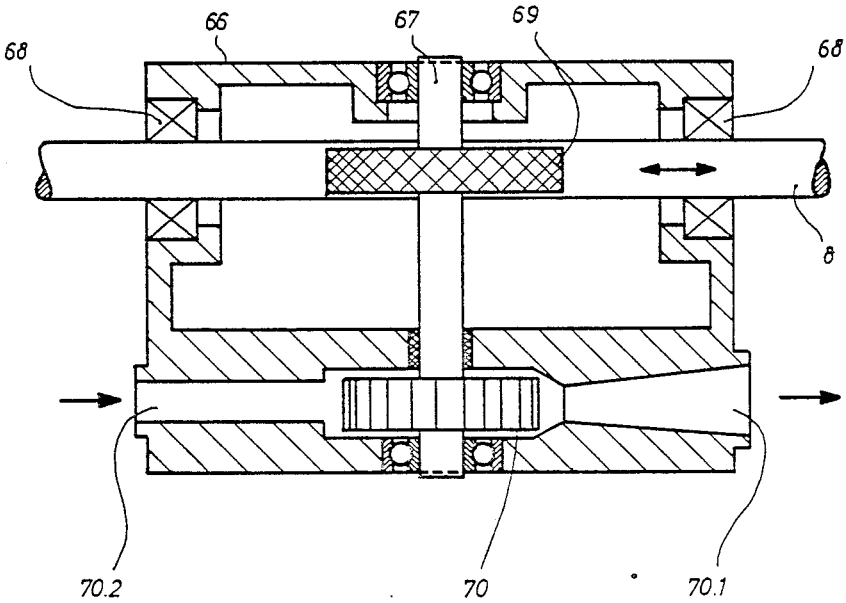
Figure 7:
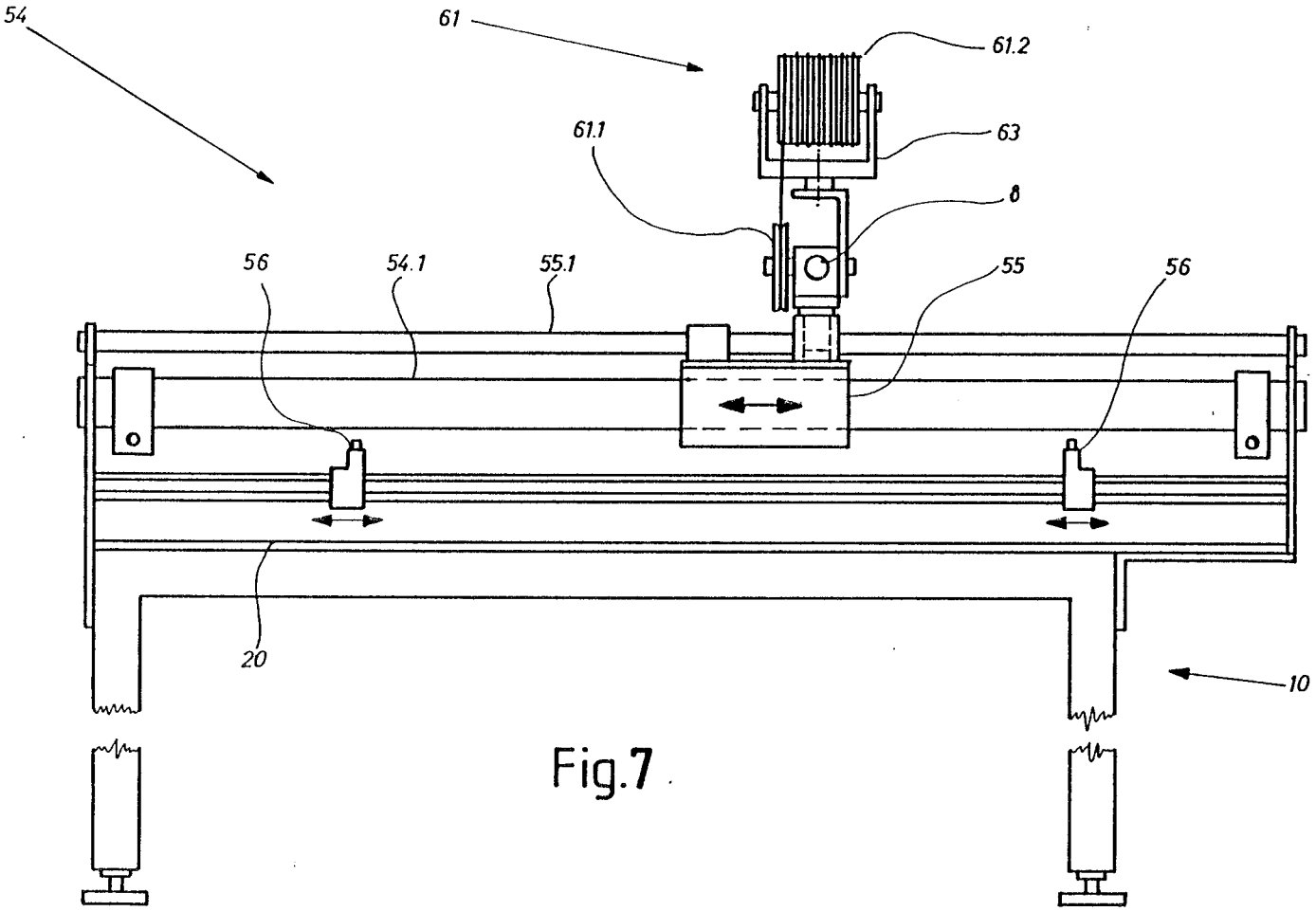
Figure 8:
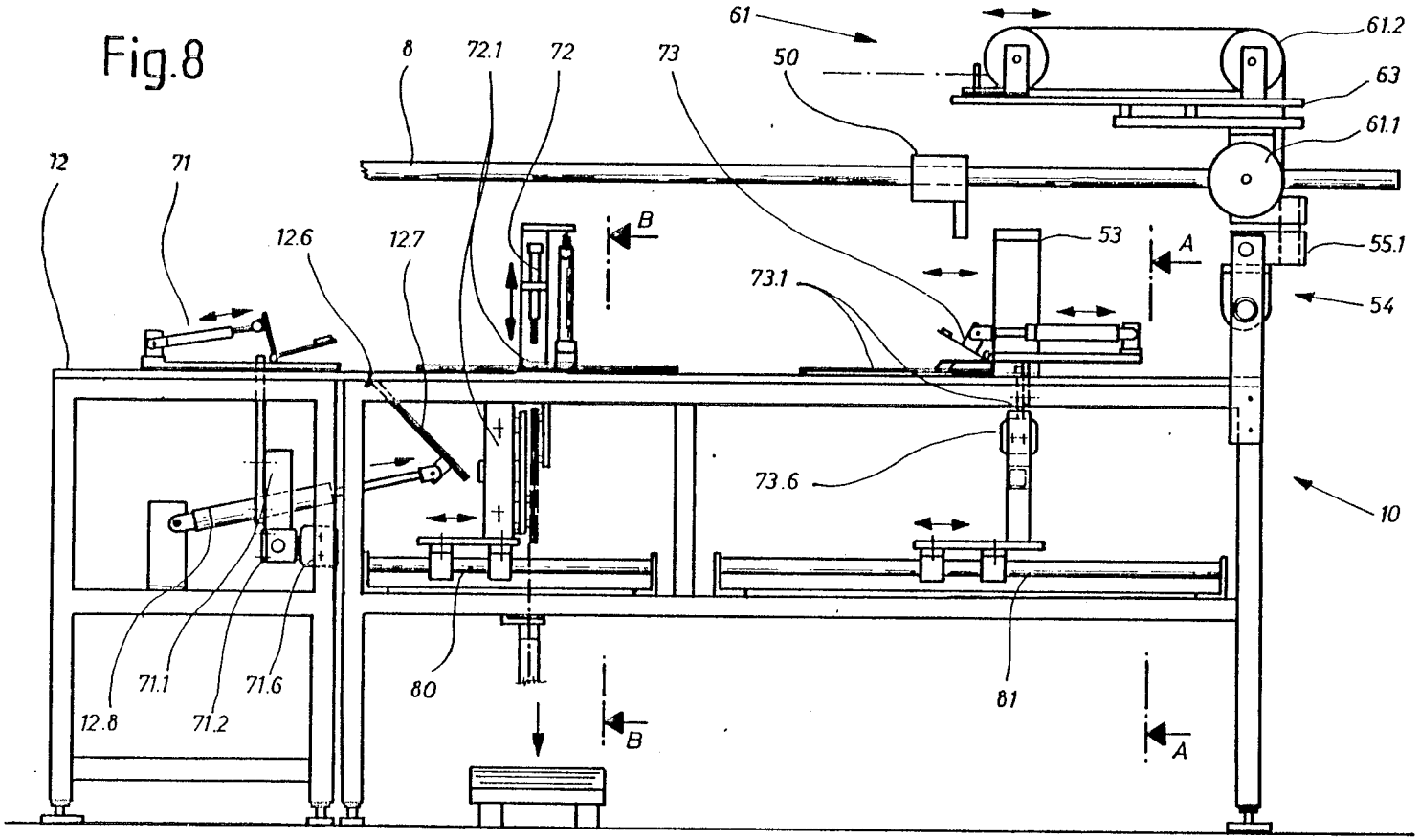
Figure 9:
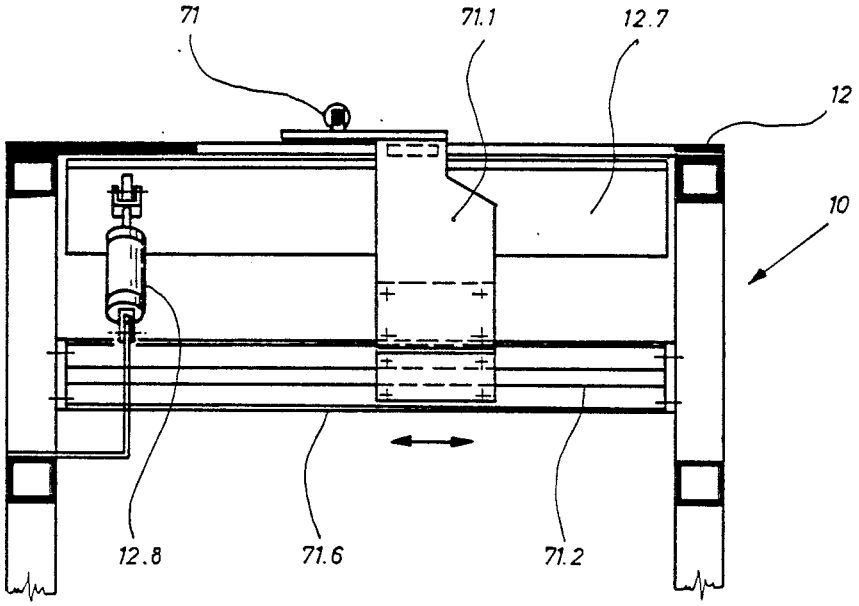
Figure 10:
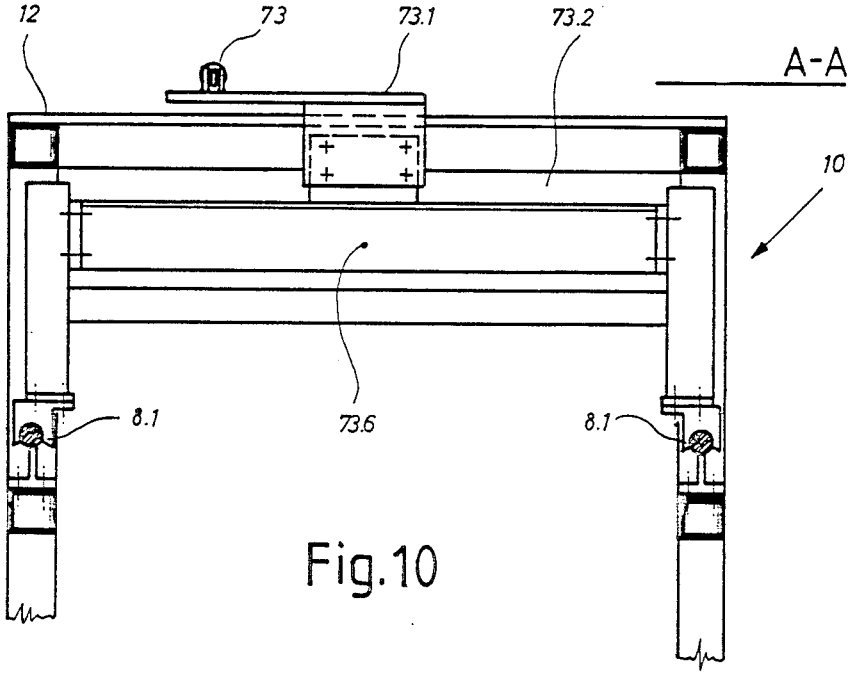
Figure 11B:
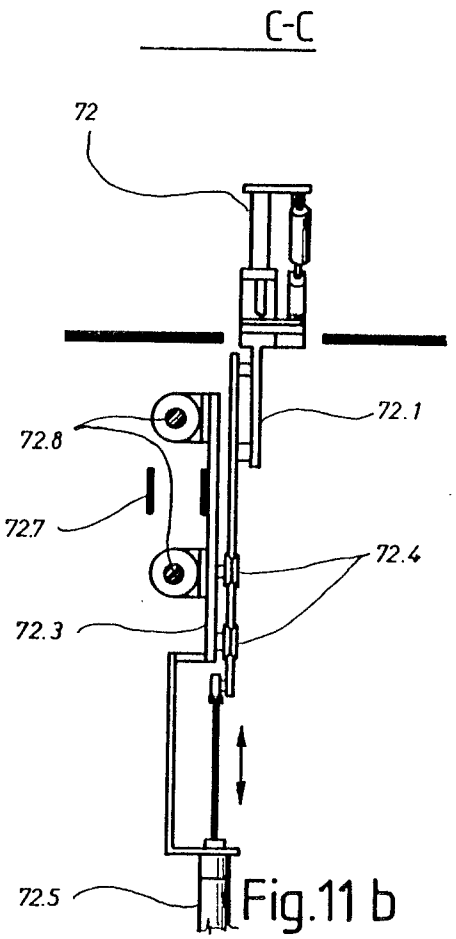
Figure 11A:
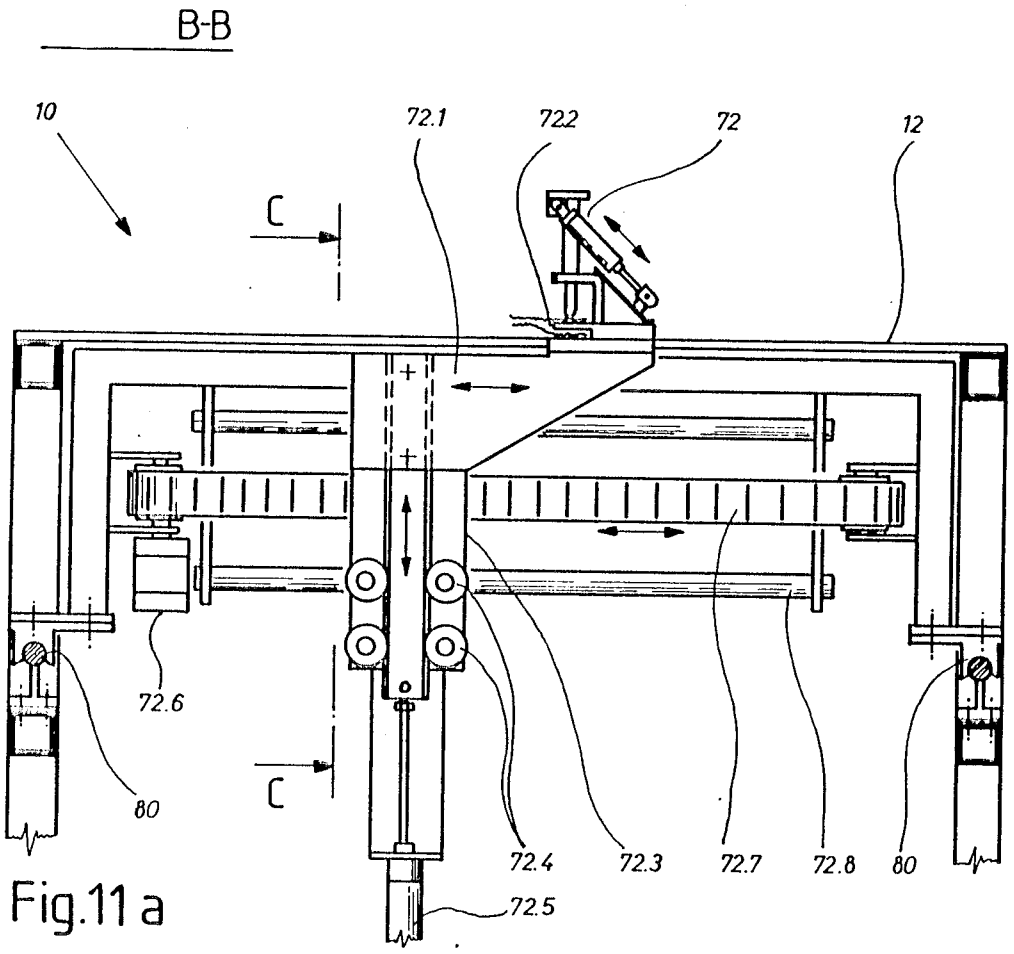

FIG. 6 shows a plan and an elevation view of a second example of the resetting drive for the gripping means according to FIGS. 5*a* and 5*b,* in section;

FIG. 7 shows a pivot drive associated with the parts according to FIG. 5*a* and extending parallel to the rear edge of the table plate of the material supply table;

FIG. 8 shows a front view of the material supply table of the apparatus according to FIG. 1;

FIG. 9 shows a side view of the material supply table according to FIG. 8 from the left;

FIG. 10 shows a sectional view of the material supply table in the sectional plane A—A of FIG. 8;

FIG. 11*a* shows a sectional view of the material supply table in the sectional plane B—B of FIG. 8; and FIG. 11*b* shows a sectional view of the material supply table in the sectional plane C—C of FIG. 11*a.*

In accordance with FIG. 1 the apparatus for performing the method of the invention comprises a set of three power-operated gripping means 1, 2, 3 for a material N to be sewn, which are adapted to be actuated with the aid of one pressure cylinder 4, 5, 6 each. Of said three gripping means 1, 2, 3, two gripping means, viz. the middle one 2 and the one 3 remotest from a sewing-machine 9 used in said method, are each disposed in a longitudinally slidable manner on a power-operated pivot arm 7, 8 in such a manner that they are movable in polar coordinates. The pivot arms 7, 8 are pivoted, in the needle region of the sewing-machine 9, to a bar or beam 11 which is angled twice and supported on a material supply table 10 near the sewing-machine 9, with the pivot arms 7, 8 being located in an elevated position relative to the material supply table 10 disposed in front of the sewing-machine 9. The substantially rectangular table plate 12 of the material supply table 10 has on each one of its two marginal portions a station 13, 14 for handling the material N to be sewn and extending parallel to the longitudinal edges of said plate; the table plate 12 has, furthermore, a recess 15 for the sewing-machine 9 at one of its corners. The gripping means 1 closest to the sewing-machine 9 is located near the holding-down foot 16 of the sewing-machine 9 and is connected to the table plate 12 in stationary manner.

In front of the sewing needle 17 of the sewing-machine 9 there are disposed two photocells 18 on the table plate 12, which in the present embodiment of the apparatus according to the invention are in functional connection with a pivot drive 19 associated with the pivot arm 7 holding the middle gripping means 2. The photocells 18 may be designed in the form of a twin photocell disposed in a common housing and having a common light source as well as a fixed narrow spacing between the two light beams thereof.

The beam 11 which is angled twice and is mounted to the table plate 12 adjacent the recess 15 for the sewing-machine 9 has a relatively longer, inner arm 21 extending substantially diagonally across the table plate 12 towards the rear edge 20 thereof, a relatively shorter, outer arm 22 extending parallel to the longitudinal edges of the plate 12, and a web 23 connecting the two beam arms 21, 22 and extending at right angles of the shorter arm 22. The two pivot arms 7, 8 are designed to have differring lengths. The shorter, outer pivot arm 7 carrying the middle gripping means 2 is pivoted to the shorter, outer beam arm 22, while the pivot joint 24 of the longer, inner pivot arm 8 is located at the apex of the angle between the web 23 and the longer, inner beam arm 21.

The pivot drive 19 serving for actuation of the shorter pivot arm 7 is pivoted on the one hand to this pivot arm 7 and on the other hand to the longer beam arm 21. This pivot drive 19 which may be a pressure drive with lifting or rotary piston or an electric stepper motor, has an adjustable position indicator 25 associated therewith by means of an auxiliary beam 26 mounted to the longer beam arm 21.

The three gripping means 1, 2, 3 and the two pivot means 7, 8, which are all designed to be power-operated, together form one of the two stations 13, 14 for handling the material N to be sewn which extend parallel to the longitudinal edges of the table plate 12, viz. the so-called take-over station 13 at which the particular material N to be sewn, in particular an elongate piece of material to be sewn, is taken over into the sewing position before commencing with the contour sewing operation. The recess 15 for receiving the sewing-machine 9 is formed at a corner of the table plate 12 adjacent the take-over station 13.

The sewing-machine 9 may be an arbitrary industrial sewing-machine of a type known per se. Behind the holding-down foot 16 of the sewing-machine 9 as seen in the sewing feeding direction, there is provided an auxiliary conveyor belt 27 which is operated by the drive motor of the sewing-machine and co-operates with the material advancing members of the sewing-machine and which serves for further transporting elongate pieces of material after sewing of a contour seam. The auxiliary conveyor belt 27 is adapted to be pivoted up and down about the axis 6 of its left-hand roller 27.1 shown in FIG. 3, simultaneously with the lifting and, respectively, lowering motion of the holding-down foot 16 of the sewing-machine 9.

FIG. 1 shows a thin-walled guide plate 30 which is mounted to the girder-like shorter pivot arm 7 and has an elongate rectangular area standing on edge and extending parallel to the girder axis. The two longitudinal edges of the guide plate 30 are each designed in the manner of a knife-edge along each of which two rollers 31 can be guided which are provided with corresponding peripheral grooves and belong to a carriage 32 carrying the middle gripping means 2 for the material N to be sewn. FIG. 1 shows merely the two upper rollers 31 of the in total four rollers 31. The carriage 32 will be described in more detail hereinafter. For movement of the carriage 32, an adjustable position indicator 33 is provided in the region of the end of the guide plate 30 facing the sewing-machine, and a stop 34, which is adjustable as well, is provided in the region of the opposite end of the guide plate 30, said position indicator and said stop each being disposed at a corresponding end of a bracket 35 extending parallel to the guide plate 30.

As regards the carriage 32, FIG. 1 shows merely a girder 36 which is vertically suspended on the rollers 31 and which has mounted thereto a supporting plate 37 for two clamping plates 38, 39 and for the middle gripping means 2 actuating said clamping plates, said supporting plate 37 being directed substantially perpendicular to the longitudinal edges of the table plate 12 and parallel to the surface thereof; the manner of mounting of the supporting plate 37 will still be described hereinafter (cp. FIGS. 4*a* and 4*b*).

The longer pivot arm 8 which has the configuration of a round bar has a carriage 50 slidably disposed thereon which is designed in the manner of a bushing and on which the gripping means 3 remotest from the sewing-machine 9 is suspended by means of a vertical beam or bar 51. An adjustable position indicator 52 at the end of the longer pivot arm 8 facing the sewing-machine 9, and an adjustable stop 53 in the region of the other end of said pivot arm serve for limiting the movement of the carriage (cp. especially FIG. 5*a*).

The bushing-like carriage 50 is supported in its interior at both ends on the longer pivot arm 8 via one ball bearing each (cp. FIG. 6). For actuation of the longer pivot arm 8 a pivot drive 54 is provided in the region of the rear edge 20 of the table plate 12 at a slightly increasing position relative to the surface of said plate. The pivot drive 54 preferably is a linear drive in the form of a pressure cylinder 54.1 which extends parallel to the rear edge 20 of the table plate 12 and has a constructional length substantially corresponding to the width of said rear edge and accommodates a magnetic pressure piston which is not shown in FIG. 1. With the aid of the pressure piston a force transmission member 55.1 is moved together therewith which is guided on a girder or rod 55 longitudinally of the outer surface of the pressure cylinder 54.1 and is mechanically coupled with the longer pivot arm 8. The two ends of the pressure cylinder 54.1 each have a positionable position indicator 56 associated therewith.

The two pivot arms 7, 8 each support a tackle block 60, 61 disposed above the particular path of movement of the associated carriage 32, 50; in FIG. 1 only the tackle block 60 of the shorter pivot arm 7 is shown completely whereas only a part of the tackle block 60 of the longer pivot arm 8 can be seen. Each of the tackle blocks 60, 61 is connected on its load side to a return drive for the particular carriage 32, 50, which is mounted to the base plate 62, 63 of the associated tackle block 60, 61, and is connected on the side of the setting-force introduction to the end of the carriages 32, 50 facing away from the sewing-machine 9 via a deflection pulley 60.1, 61.1 which is supported on the associated pivot arm 7, 8. Of said two return drives FIG. 1 shows only the one 64 provided on the shorter pivot arm 7. The two tackle blocks 60, 61 are similar to each other. Each of them consists of two sets 60.2, 61.2 of seven coaxial pulleys or rollers 60.3, 61.3 each (cp. also FIGS. 3 and 5*a*).

The position indicators 25, 33, 52 and 56 are all designed as an inductive proximity switch.

In the marginal portion of the table plate 12 located opposite the take-over station 13, i.e. in FIG. 1 along the forward longitudinal edge of the plate, there is provided a so-called insertion station 14 comprising an additional set of three gripping means 71, 72, 73 for the material N to be sewn, which are adapted to be actuated independently of each other. At the insertion station 14 it is possible to position the particular successive material N during the sewing operation carried out at that time, and this fact permits considerable acceleration of production. The last-mentioned three gripping means 71, 72, 73 are each mounted to a base 71.1, 72.1, 73.1 each coupled to a sliding or displacement drive. FIG. 1 illustrates merely a part of the sliding drive 72.6 of the gripping means 72 disposed in the middle. As will be described in more detail hereinafter, the guides 71.2, 72.8, 73.2 of the bases 71.1, 72.1, 73.1 extend parallel to each other and perpendicular to the longitudinal edges of the table plate 12 and are disposed under correspondingly oriented individual slots 12.1, 12.3, 12.3 of the table plate in the frame of the material supply table 10. The bases 71.1, 72.1, 73.1 projecting through the slots 12.1, 12.2, 12.3 of the table plate 12, together with the gripping means 71, 72, 73 mounted thereon, are adapted to be reciprocated between the insertion station 14 and the take-over station 13 and, upon each approach to the take-over station 13, are each adapted to be moved towards the corresponding gripping means 1, 2, 3 thereof. The middle or central one 72 of the three gripping means 71, 72, 73 associated with the insertion station 14 is adapted to be lowered together with the associated base 72.1 beneath the surface of the table plate 12 so as to provide for an underfloor return of said gripping means from the take-over station 13 to the insertion station 14.

The table plate 12 may be extended, if required. For this purpose, the plate consists of two parts 12.4 and 12.5 abutting each other along a separating line 12.6. For closing the gap arising at the separating line 12.6 upon extension of the table plate 12, a power-operated flap 12.7 illustrated in broken lines in FIG. 1 is pivoted to the bottom side of the table plate 12 along the separating line 12.6. In connection with an extension or re-shortening of the table plate 12, it is of course also necessary to correspondingly position the sliding drives of the middle gripping means 72 and the gripping means 73 remotest from the sewing-machine 9, along with the bases 72.1, 73.1 thereof by means of guides associated therewith (cp. also FIGS. 8 to 11*b*). Each positioning operation takes place simultaneously with the adjustment of the initial position of the gripping means 2 and 3 on the two pivot arms 7 and 8. On the front side of the table frame, FIG. 1 shows guide means 80, 81 provided for positioning said parts. Further details in this respect can be gathered from the explanations on FIGS. 8 to 11*b* given hereinafter.

Figure 2:
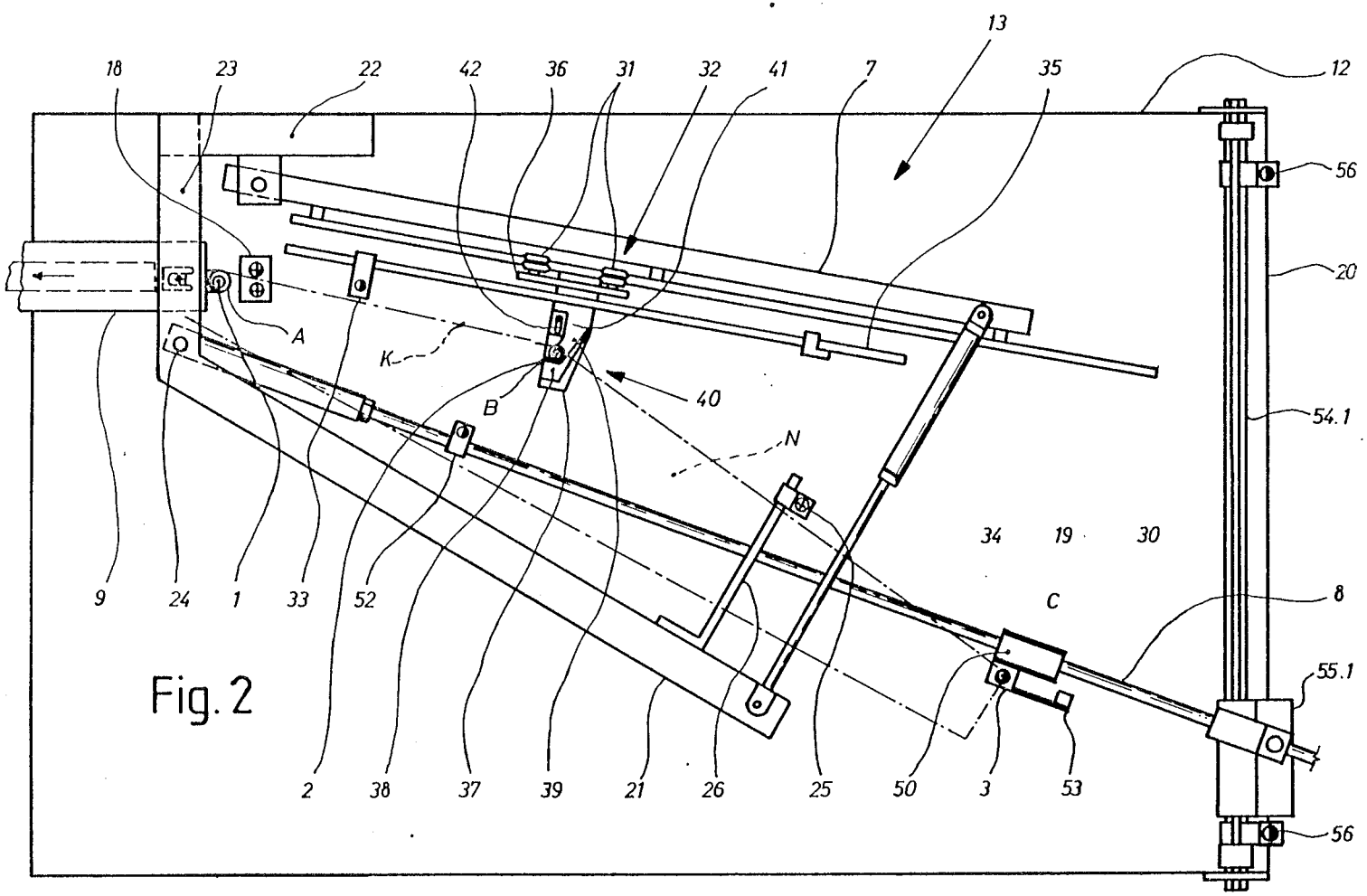
FIG. 2 shows a plan view of the apparatus for sewing contours according to FIG. 1.

FIG. 2 shows a perspective view, at enlarged scale, of the apparatus for sewing contours according to FIG. 1 which at the same time forms also a take-over station 13 for the material N to be sewn; the tackle blocks 60, 61 are, however, not shown in FIG. 1. The forward, stationary gripping means 1 and the twin photocell 18 are thus visible more clearly in FIG. 2. Furthermore, it can be seen from this figure that the supporting plate 37 and the two clamping plates 38, 39 attached thereto, which together form the horizontal part 40 of the carriage 32 disposed on the shorter pivot arm 7,are all of trapezoidal shape and have a surface area which decreases in the sequence of the parts indicated. Moreover, it is also possible to see the contours of a recess 41 for the middle gripping means 2 which is formed in each of the clamping plates 38, 39 in a portion facing the bracket 35, and it is possible to see the contours of a smaller elongate opening 42 within the recesses 41 for a photocell 58 serving for controlling the gripping means 2 (cp. also FIGS. 4*a* and 4*b*). The gripping means 2 and the photocell 58 are not indicated in FIG. 2.

Figure 3:
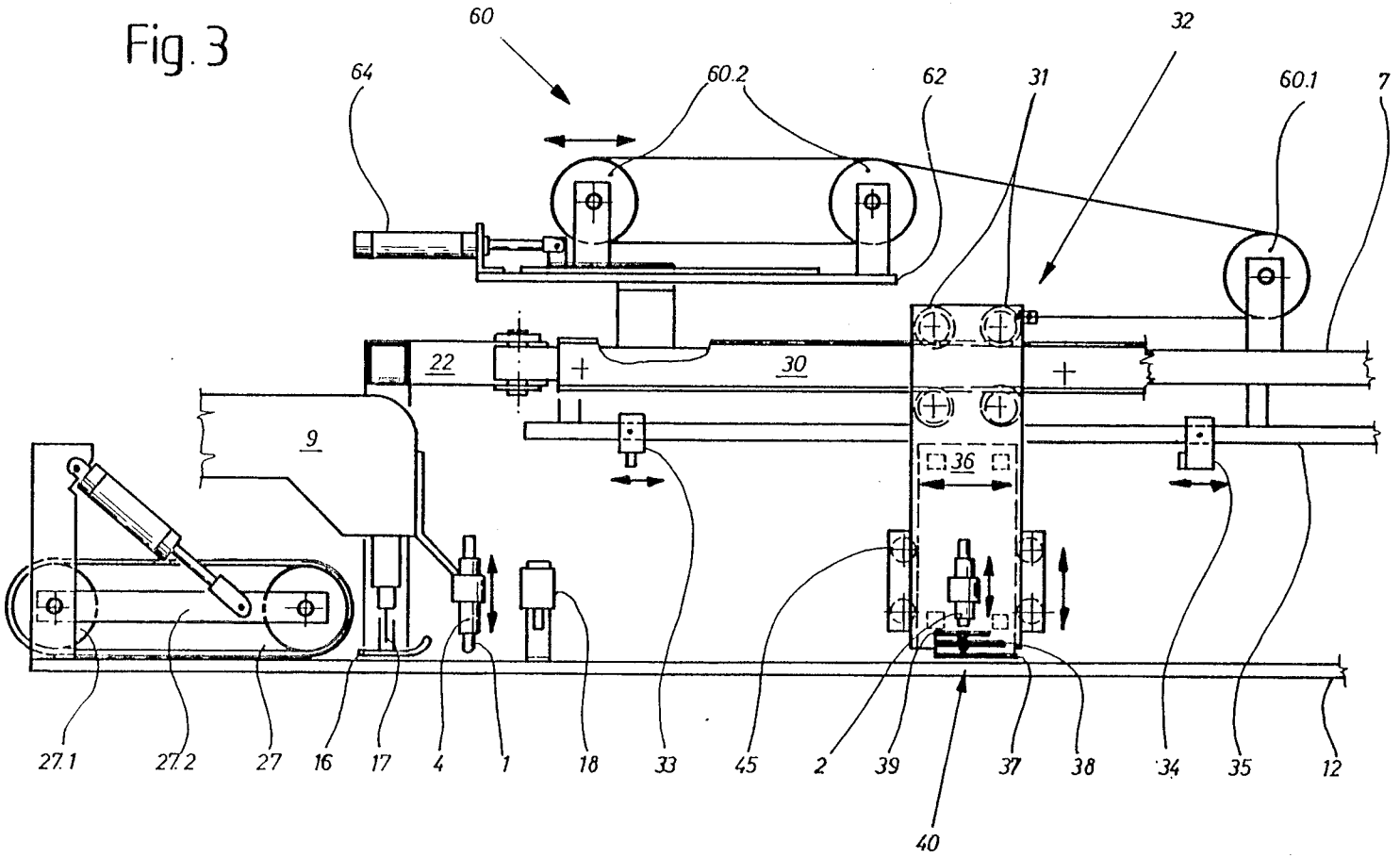
FIG. 3 shows a sewing-machine illustrating parts of the apparatus according to FIG. 2 serving to guide the stitch chain in opto-electronic manner.

FIG. 3 shows details of parts of the apparatus according to FIG. 2. This figure shows, at an enlarged scale, the sewing needle 17 and the holding-down foot 16 of the sewing-machine 9 together with the twin photocell 18 disposed in a front or upstream position of said foot, the auxiliary conveyor belt 27 disposed in a subsequent or downstream position, and the stationary, forward gripping means 1, as well as the shorter pivot arm 7 together with the carriage 32 disposed thereon. This figure illustrates in particular the way of guiding of the carriage 32 by means of the four rollers 31 which are arranged in pairs on the two blade-like longitudinal edges of the guide plate 30. In addition thereto, this figure also shows the similarly designed way of guiding the liftable and lowerable horizontal part 40 of the carriage 32 on the vertical girder 36 thereof, which again is effected by means of four rollers 45.

FIG. 4a again illustrates, at enlarged scale, the carriage 32 of the shorter pivot arm 7 according to FIG. 3 in a side view. The construction for guiding the horizontal motion of the carriage 32 on the shorter pivot arm on the one hand, and for guiding the lifting and lowering motion of the horizontal part 40 of the carriage 32 along the vertical girder 36 thereof on the other hand, as well as the construction of the horizontal part 40 proper are shown in detail in this figure. The guiding construction for the horizontal movements of the carriage 32 consists of the thin-walled guide plate 30 secured to the shorter pivot arm 7 and having the knife- or blade-like longitudinal edges and of the rollers 31 having circumferential grooves, which are disposed on the surface of the vertical girder 36 facing the guide plate 30. For lifting and lowering the horizontal part 40, the vertical bar or girder 36 has, below the rollers 31, an additional thin-walled and elongated guide plate 44, and two pairs of rollers 45 having circumferential grooves are again movable along the two blade-like longitudinal edges of said plate 44. The latter rollers 45 are mounted to a connecting plate 46 which is bent so as to extend vertically upright and is screwed to the supporting plate 37.

The construction of the horizontal part 40 is illustrated in the lower part of FIG. 4a as well as in the plan view of FIG. 4*b* shown therebelow. Two screw bolts 48 anchored to the supporting plate 37 each penetrate a corresponding circular opening 38.1, 38.2, 39.1, 39.2 in the clamping plates 38, 39. A spiral spring 49 is disposed around each screw bolt 48 and is supported with its lower end against a stop ring 38.3 or 39.3 each mounted around the circular opening 38.2 or 39.1 of the associated clamping plate 38 or 39, and is supported with its upper end against a tensioning nut 49.1 threaded onto each associated screw bolt 48. The pivoting motion of the clamping plates 38, 39 is thus limited. As can be seen especially in FIG. 4*b*, the two clamping plates 38, 39 each have a recess 41, and along the arcuate side thereof facing away from the pivot joint 47, there is inserted a correspondingly bent material or fabric guide plate 47 having a tangential end part facing in sewing feed direction; the plate 57 is screwed to the supporting plate 37. Within the outlines of the two congruent recesses 41 there is provided in said supporting plate 37 an elongate opening 42 which is small in comparison with the recesses 41 and via which light is applied from a photocell 58, which serves for controlling the middle gripping means 2, through the put-together edges of the two fabric or material layers of the material N to be sewn which are each supplied between the two clamping plates 38, 39 on the one hand and between the lower clamping plate 38 and the supporting plate 37 on the other hand. The middle gripping means 2 is mounted, together with the photocell 58, to a profile carrier 59 which is also mounted to the supporting plate 37 as shown in FIG. 4*a*, with the gripping means 2 being mounted thereto in such a manner that the actuation pin 2.1 of the means 2 can effect a clamping movement of the two clamping plates 38, 39 while the photocell 58 is directed onto the elongate opening 42 in the supporting plate 37.

A clamping effect is achieved in that buffer projections 38.4, 39.4 in the form of spherical indentations formed at the free end of each of the two clamping plates 38, 39 hit against the particular plate 38 and 37, respectively, located therebeneath, due to pressure exerted by the actuation pin 2.1 on the upper clamping plate 39.

The leading or entrance edges of the supporting plate 37 and of the clamping plates 38, 39 towards which the material layers of the material N to be sewn move during the sewing operation are inclined with respect to the trailing or exit edges thereof which extend normal to the sewing feed direction. Starting from the supporting plate 37 the leading edges are increasingly offset backwardly in sewing feed direction. The leading edge of the upper clamping plate 39 is bent upwardly and the plates 37, 38, 39 are getting smaller and smaller in this sequence.

FIG. 5*a* shows, in an enlarged view, the longer pivot arm 8 together with all members disposed thereon, as already shown in FIG. 1 except for the complete tackle block 61. This figure illustrates the tackle block 61 disposed on the longer pivot arm 8, together with the return drive 65 missing in FIG. 1 and with the roller set 61.2 which is not shown in FIG. 1 either. Each return drive 64 (cp. FIGS. 1 and 3) or 65 is provided in the form of a pressure cylinder whose pressure piston 64.1, 65.1 includes a specific seal 64.2, 65.2 ensuring an invariable amount of friction of low value during the stroke or movement thereof.

FIG. 5*b* shows a side view of the gripping means 3 disposed on the vertical beam 51 and located remotest from the sewing-machine 9.

FIG. 6 shows a plan and an elevation view, both in section and the elevation view seen from the rear, of a carriage 66 for the longer pivot arm 8, which in fact is of bushing-like design but is nevertheless constructed differently. As can be seen especially from the plan view, a shaft 67 is supported between two ball bearings 68 in the interior of the carriage 66 perpendicular to the longitudinal axis of the carriage, and on the shaft 67 there are disposed a friction wheel 69 rolling on the surface of the longer pivot arm 8 and a turbine wheel 70 driving the latter wheel, as well as a connection channel 70.1 and, respectively, 70.2 provided on both sides of said turbine wheel in the wall of the carriage 66 and serving for supplying and, respectively, discharging a pressure medium, such as e.g. pressurized air.

The pivot drive 54 for actuation of the longer pivot arm 8 is shown in full length in the enlarged side view according to FIG. 7. Furthermore, this figure clearly shows also the force transmssion member 55.1 together with the girder or bar 55 serving for guiding the same, the rear end of the longer pivot arm 8 together with the rear roller set 61.2 and the deflection roller 61.1 of the tackle block 61 disposed thereon, as well as the two positionable position indicators 56.

The front view of the material supply table 10 according to FIG. 8 shows, beginning from the top thereof, parts of the longer pivot arm 8, the associated tackle block 61 and of the pivot drive 54 in front view. Therebeneath this figure shows the three gripping means 71, 72, 73 of the insertion station 14, which are located above the table plate 12 and are shown together with their bases 71.1, 72.1, 73.1 projecting below the table plate 12, and together with the sliding drives 71.6, 72.6, 73.6 of said bases as well as the guide means 80, 81 for longitudinal adjustment of the gripping means 72, 73 in case of an alteration of the table length. Moreover, at the bottom side of the table plate 12, the flap 12.7 mounted along the separating line 12.6 thereof is also visible along with its actuation drive 12.8.

The gripping means 71 of the insertion station 14 closest to the sewing-machine 9 as well as the supporting and movement mechanism thereof consisting of base 71.1, guide 71.2 and sliding drive 71.6, and the flap 12.7 used for extending the table as well as the actuation drive 12.8 thereof, are shown once more in FIG. 9 in an enlarged side view.

FIG. 10 shows an enlarged side view of the gripping means 73 of the insertion station 14 remotest from the sewing-machine 9, together with its supporting and movement mechanism consisting of base 73.1, guide 73.2, sliding drive 73.6 and the guide means 81 for longitudinal adjustment of said parts upon table length alteration.

Each sliding drive 71.6 or 73.6 is provided in the form of a band cylinder.

Finally, FIG. 11*a* shows a side view of the middle gripping means 72 of the insertion station 14 together with the supporting and movement mechanism thereof seen in section plane B—B through the material supply table 10 according to FIG. 8 at enlarged scale, and FIG. 11*b* shows a sectional view of the supporting and movement mechanism along sectional plane C—C in FIG. 11*a*. The supporting and movement mechanism of the middle gripping means 72 comprises a base 72.1 which is disposed on a carriage 72.3 and guided between four rollers 72.4 in such a manner that is slidable up and down in vertical direction.

The carriage 72.3 is slidable by means of toothed belt 72.7 along two guide rods 72.8 extending perpendicular to the longitudinal edges of the table plate 12. The vertical sliding motion is carried out with the aid of a pressure cylinder 72.5, while the sliding drive 72.6 operating the toothed belt 72.7 is an electrical stepper motor.

The cut fabric edges of the elongate pieces of a material to be sewn, e.g. of a trouser leg, which are to be joined together by means of a contour seam (side seam), are placed onto each other at the insertion station 14 together with additional parts to be sewn in as well, such as lining, pocket bag etc., such that they correspond to the sewing position, and the parts are clamped at three gripping points A, B, C by means of the three gripping means 71, 72, 73 of the insertion station 14 (cp. the contours outlined in broken lines in FIG. 1). In the case of a trouser leg, the length of the material supply table 10 and thus also the position of the middle gripping means 72 of the insertion station 14 as well as the position of the gripping means 73 thereof remotest from the sewing-machine 9 is adjusted, by actuation of the guide means 80, 81 before fixing the material pieces in spread manner on the insertion station 14, such that the so-called point of attachment of the pocket bag which constitutes a first gripping point B and coincides with the lower end of a hip curve or bend formed by the cut of the fabric edges, can be held at the middle gripping means 72 together with the adjacent fabric edges. An additional gripping point A selected at the waistband region of the trouser leg is then clamped at the gripping means 71 closest to the sewing-machine 9, and a third gripping point C provided at the lower end of the trouser leg is clamped at the third gripping means 73. The afore-mentioned gripping points A, B, C are located on a counter line K extending in the region of the cut fabric edges of the pieces of the particular material N which are to be sewn together; the contour seam will be guided on this contour line in the subsequent sewing operation by means of the photocells 18.

Actuation of the guide means 80, 81 is effected automatically due to a longitudinal adjustment of the middle gripping means 2 on the shorter pivot arm 7, with the gripping means 3 movable on the longer pivot arm 8 being correspondingly adjusted together therewith (cp. also FIG. 2).

When the material N to be sewn has been clamped by means of the three gripping points A, B, C and when the gripping means 2 and 3 of the take-over station 13 simultaneously are in their initial position, the sliding drives 71.6, 72.6, 73.6 of the gripping means 71, 72, 73 of the insertion station 14 are put into operation with the aid of a foot-lever, which is not shown. The gripping means 71, 72, 73 transport the material N to be sewn to the gripping means 1, 2 and 3 of the take-over station 13, with the fabric edges of the material N reaching the gripping region thereof. Stopping of the sliding drives 71.6, 72.6, 73.6, gripping of the material N at the three gripping points A, B, C by the grippingmeans 1, 2, 3 of the take-over station 13, and release of the material N from the gripping means 71, 72, 73 of the insertion station 14 are effected, in case of the middle pair of gripping means 72-2 by means of the photocell 58 disposed on the supporting plate 37 for the gripping means 2 and, in case of the two other pairs of gripping means 71-1 and 73-3, by means of one proximity switch each, these switches being not shown either. After the completed transfer of the material N to be sewn from the one set of gripping means 71, 72, 73 to the other set of gripping means 1, 2, 3, such that the material N is in the position shown in broken lines in FIG. 2, the sewing operation is started and at the same time the material N to be sewn is released from the gripping means 1 in gripping point A.

For providing a perfect sewing operation, it is of decisive significance that the fabric layers of the material N to be sewn are joined together exactly. In order to achieve this despite the fact that most superimposed fabrics do not permit shifting relative to each other because of the adhesive friction acting between them, the two fabric layers of the material N that are to be joined together with a contour seam are clamped, in the region of the gripping point B, already at the gripping means 72 of the insertion station 14 in such a manner that they are separated from each other by an intermediate plate 72.2 (cp. FIG. 11*a*). This is also the reason why the gripping means 2 of the takeover station 13, to which the gripping point B is transferred when transferring the material N to be sewn from the insertion station 14 to the take-over station 13, is designed with three plates, viz. the supporting plate 37 and the two clamping plates 38, 39. Thus, when the material N to be sewn is transferred, the upper fabric layer thereof is held between the two clamping plates 38, 39, and the lower fabric layer thereof is held between the lower clamping plate 38 and the supporting plate 37 (cp. FIGS. 1 to 4).

During the sewing operation, the contour seam is carried out at first along the hip curve, forming the first section of contour line K. Under the effect of the material advancing means of the sewing-machine 9, the material N to be sewn is moved towards the latter, with the fabric edges passing in sewing feed direction between the photocells 18 and the two gripping means 2 and 3 on the pivot arms 7 and 8, respectively, moving together therewith at the same time. Should the fabric edges and thus also the contour line K display during this operation a tendency of leaving the band width defined by the position of the photocells 18, the pivot drive 19 of the shorter pivot arm 7 carrying the gripping means 2 will be caused, by control of said photocells, to effect a change of direction of the fabric edges moving towards the sewing needle 17 of the sewing-machine 9, during which the gripping means 2 of course holds the two fabric layers of the material N, including the pocket attachment, together in the gripping point B until said point reaches the sewing needle 17. Thus, an opto-electronic guidance of the stitch chain or sequence is effected rapidly and without intervention of any operator whatsoever.

As a consequence of a corresponding pre-adjustment of the position indicator 33 on the bracket 35 of the shorter pivot arm 7, the carriage 32 guiding the movement of the gripping means 2 on the shorter pivot arm 7 comes to a stand-still at said position indicator 33 at the end of the first part of the sewing operation at which the hip curve ends. The position indicator also effects release of the gripping means 2 so that the further course of the sewing operation is not hindered. The photocells 18 are deactivated, and the gripping means 71, 72, 73 of the insertion station 14 are automatically returned to their initial position, so that the latter are ready for receiving a subsequent material N to be sewn.

In the present embodiment of the invention, the further course of the sewing operation consists, so to speak, in a second section in which the stitch chain of the contour seam is mechanically guided parallel to the contour line K which now is substantially rectilinear. For doing so, the longer pivot arm 8 carrying the gripping means 3 remotest from the sewing-machine 9 has been pivoted by means of its pivot drive 54 already during the first section of the sewing operation at a predetermined constant speed from its initial position on the position indicator 56 associated with said arm on the side of the insertion station 14, to an operating position on the previously adjusted position indicator 56 associated with said arm on the side of the take-over station 13. Upon start of the second section of the sewing operation the material N to be sewn is thus guided mechanically from the gripping means 3 sliding on the stationary longer pivot arm 8, in the direction towards the sewing-machine 9. In doing so, the fabric edges pass between the opened supporting and clamping plates 37 and, respectively, 38, 49 of the gripping means 2 which is also stationary, so that exact joining together of the fabric edges remains ensured.

During the running sewing operation, the next material N to be sewn can be placed ready at the insertion station 14.

At the end of the sewing operation the gripping means 3 guided on the longer pivot arm 8 comes to a standstill at the previously adjusted position indicator 52 at the end of this pivot arm facing the sewing-machine 9. The position indicator 52 effects on the one hand release of the gripping means 3 so that the material N, after having passed under the the sewing needle 17, can be conveyed further by the auxiliary conveyor belt 27 to a deposit means. On the other hand, there is effected the return of the two pivot arms 7, 8 and of the two gripping means 2, 3 slidable thereon into their initial position in which the latter can take over new material N to be sewn.

The two tackle blocks 60, 61 disposed on the two pivot arms 7, 8 exert a slight counter-acting tension on the material to be sewn during the sewing operation, so that the fabric edges thereof are fed to the sewing-machined 9 in tensioned condition.

The present invention permits the making of contour seams in rapid and qualitatively perfect manner, while the assistance of experienced operating personnel can largely be dispensed with.

I claim:

1. A method of making contour seams on material to be sewn, in particular elongated pieces of material to be sewn, wherein before the sewing operation, the material to be sewn is clamped in spread manner in sewing position at first, second and third gripping points provided along a contour line which is determined by a pattern of superimposed cut fabric edges of pieces of the material which are to be joined together, the first gripping point closest to the sewing-machine being stationary and the second and third gripping points each being supported so as to be movable in a polar coordinate system, and wherein in at least part of the sewing operation, which is initiated in each particular case with simultaneous release of the material in the stationarily mounted first gripping point, the stitch chain is guided parallel to the contour line under opto-electronic control.

2. A method according to claim 1, wherein at least a first section of the contour line represents a curved part having an arbitrarily variable curvature.

3. A method according to claim 1, wherein in an additional part of the sewing operation following the part in which the stitch chain is guided under opto-electronic control, the stitch chain is guided further parallel to a rectilinear contour line under mechanical control.

4. A method according to claim 1, wherein the opto-electronic control of the stitch chain has the effect of influencing merely the movement of the second gripping point in its polar coordinate system.

5. A method according to claim 3, wherein the mechanical guidance of the stitch chain is carried out by a linear displacement of the third gripping point most remote from the sewing-machine after the material to be sewn is released at the second gripping point which is stationary after having passed its opto-electronically controlled path, the second gripping point, being in a released condition, providing simultaneous guidance of the fabric edges of the pieces of the material to be joined together, which move towards the sewing-machine.

6. A method according to claim 1, wherein the material to be sewn is gripped at the first, second and third gripping points at an insertion station and then transferred to a sewing position at a take-over station.

* * * * *